United States Patent [19]

Takehisa et al.

[11] Patent Number: 4,955,424

[45] Date of Patent: Sep. 11, 1990

[54] DIE-CASTING METHOD AND DEVICE

[75] Inventors: Fumitaka Takehisa, Anjo; Fumio Kondoh, Nagoya; Mitsuyoshi Yokoi, Takahama, all of Japan

[73] Assignee: Nippondenso Co., Ltd., Kariya, Japan

[21] Appl. No.: 391,393

[22] Filed: Aug. 9, 1989

Related U.S. Application Data

[63] Continuation of Ser. No. 160,987, Feb. 26, 1988, abandoned.

[30] Foreign Application Priority Data

| | | | |
|---|---|---|---|
| Feb. 28, 1987 | [JP] | Japan | 62-45824 |
| Dec. 23, 1987 | [JP] | Japan | 62-326560 |
| Jan. 20, 1988 | [JP] | Japan | 63-11582 |

[51] Int. Cl.[5] ..... B22D 17/00

[52] U.S. Cl. ..... 164/72; 164/113; 164/312

[58] Field of Search ..... 164/72, 74, 267, 113, 164/119, 306, 312; 425/90, 95

[56] References Cited

U.S. PATENT DOCUMENTS

| | | | |
|---|---|---|---|
| 3,645,319 | 2/1972 | Pondelicek et al. | 164/72 |
| 3,978,908 | 9/1976 | Klaus et al. | 164/72 |
| 4,425,411 | 1/1984 | Textor et al. | 164/72 |
| 4,562,875 | 1/1986 | Ogoshi et al. | 164/72 |
| 4,586,560 | 5/1986 | Ikeya et al. | 164/457 |
| 4,738,297 | 4/1988 | Takagi et al. | 164/72 |
| 4,762,163 | 8/1988 | Takehisa et al. | 164/72 |

FOREIGN PATENT DOCUMENTS 60-238074 11/1985 Japan .

OTHER PUBLICATIONS

Patent Abstracts of Japan, vol. 9, No. 303, A 60-141349 published 7/1985.

Patent Abstracts of Japan, vol. 10, No. 55, A 60-203335 published 10/1985.

Patent Abstracts of Japan, vol. 9, No. 179, A 60-49851 published 3/1985.

Patent Abstracts of Japan, vol. 11, No. 338, A 62-156063 published 7/1987.

*Primary Examiner*—Richard K. Seidel

*Attorney, Agent, or Firm*—Cushman, Darby & Cushman

[57] ABSTRACT

A die-casting method in which a lubricant is heated to a temperature higher than a temperature of mold cavity surfaces before molten metal is injected into the mold cavity. The lubricant is heated when the mold cavity is formed by bringing a movable mold into contact with a stationary mold. The heated lubricant is introduced into the mold cavity and applied on the mold cavity surfaces, and the molten metal is then injected into the mold cavity. The molten metal is allowed to solidify in the mold cavity to become a solidified article. A die-casting device for carrying out this method is also provided according to the present invention.

23 Claims, 9 Drawing Sheets

DIE-CASTING METHOD AND DEVICE

This is a continuation of application Ser. No. 07/160,987, filed Feb. 26, 1988, which was abandoned upon the filing hereof.

BACKGROUND OF THE INVENTION

1. Field of the Invention

The present invention relates to a die-casting method and device particularly useful for the die-casting of an aluminum alloy.

2. Description of the Related Art

In a conventional die-casting, after a movable mold is released from a stationary mold and an article is removed from the molds, a molding release agent, i.e., a lubricant, is blown on surfaces of the molds as lubrication, so that adhesion of molten aluminum to the molds is reduced and thus the die-casting process can be carried out continuously. The molding release agent is blown onto cavities formed on the molds for die-casting the article to a desired shaped form, especially on portions of such cavities where molten metal is introduced through passages formed in the molds, and on portions having a complex configuration. With such a construction, if a plurality of articles are to be molded at the same time, the molding release agent must be blown onto the cavities for a long time, thus lengthening the cycle time and lowering the productivity.

In an attempt to solve this problem, Japanese Unexamined Patent Publication Nos. 60-49851 and 61-20654 disclose methods in which the lubrication of the molds cavities is carried out by providing an injection sleeve having a plunger, for supplying the lubricant into the cavities.

This conventional die-casting method, however, has the following problems. Namely, the lubricant applied to the movable and stationary molds becomes mixed with the molten metal while the molten metal is being injected into the mold cavities, and since the lubricant becomes liquid or gaseous during this mixing, the lubricant mixed in the molten metal may expand when the solidified article is heated during a later process (for example, in a heat treatment such as an aging treatment after a solution heat treatment), thus causing a deformation of the article.

To solve this problem, the present inventors disclosed, in Japanese Unexamined Patent Publication No. 62-156063, a method and a device in which the lubricant is blown on a portion in the mold having a highest temperature, to be decomposed before being introduced into the mold cavities so that the surfaces of the molds are lubricated. In this method, the article is not deformed even when subjected to a heat treatment after solidification. Nevertheless, although this method and device are satisfactory if the number of articles to be die-cast at one time is relatively small and sufficient lubrication is obtained, if the number of articles to be die-cast at one time is relatively large, the amount of lubricant supplied into each mold cavity is different in each cavity. Therefore, in a cavity where the amount of the supplied lubricant is small, molten aluminum adheres to the surface of a complex shape cavity portion after each molding, and if the amount of lubricant supplied to the cavity is too large, the lubricant may not be fully decomposed.

SUMMARY OF THE INVENTION

Therefore, an object of the present invention is to improve the above described method and device created by the present inventors.

Another object of the present invention is to provide a die-casting method and device by which, even if the number of die-cast articles is large, molten metal does not adhere to a complex shaped portion of a mold.

According to the present invention, there is provided a die-casting method using a first mold having a mold cavity surface, a second mold having a mold cavity surface and brought into contact with the first mold so that the mold cavity surfaces of the first and second molds define a mold cavity, means for ejecting from the mold cavity a solidified article made by allowing the molten metal to solidify, and a heating device for heating a lubricant.

In this method, in the first step, the mold cavity is formed by bringing the second mold into contact with the first mold. In the second step, the lubricant is heated to a temperature higher than a temperature of the mold cavity surfaces of the first and second molds before the molten metal is injected into the mold cavity. In the third step, the lubricant heated by the heating device is introduced into the mold cavity so that the lubricant is applied on the mold cavity surfaces of the first and second molds. In the fourth step, the molten metal is injected into the mold cavity. In the fifth step, the molten metal is allowed to solidify in the mold cavity. In the sixth step, the second mold is separated from the first mold, and then, in the seventh step, the solidified article is ejected from the mold cavity.

According to the present invention, there is provided a die-casting device having first and second molds, an injection sleeve, an injection plunger, heating means, and an introducing means. The first mold has a mold cavity surface, and the second mold also has a mold cavity surface. The second mold is brought into contact with the first mold so that the mold cavity surfaces of the first and second molds define a mold cavity. The injection sleeve is provided for injecting molten metal into the mold cavity, and the injection plunger is slidably disposed within the injection sleeve to inject the molten metal into the mold cavity. The heating means heats a lubricant to a temperature higher than a temperature of the mold cavity surfaces of the first and second molds before the molten metal is injected into the mold cavity, and the introducing means introduces the lubricant heated by the heating means into the mold cavity.

BRIEF DESCRIPTION OF THE DRAWINGS

The present invention may be more fully understood from the description of the preferred embodiments of the invention set forth below, together with the accompanying drawings, in which.

DESCRIPTION OF THE PREFERRED EMBODIMENTS

Figure 1:
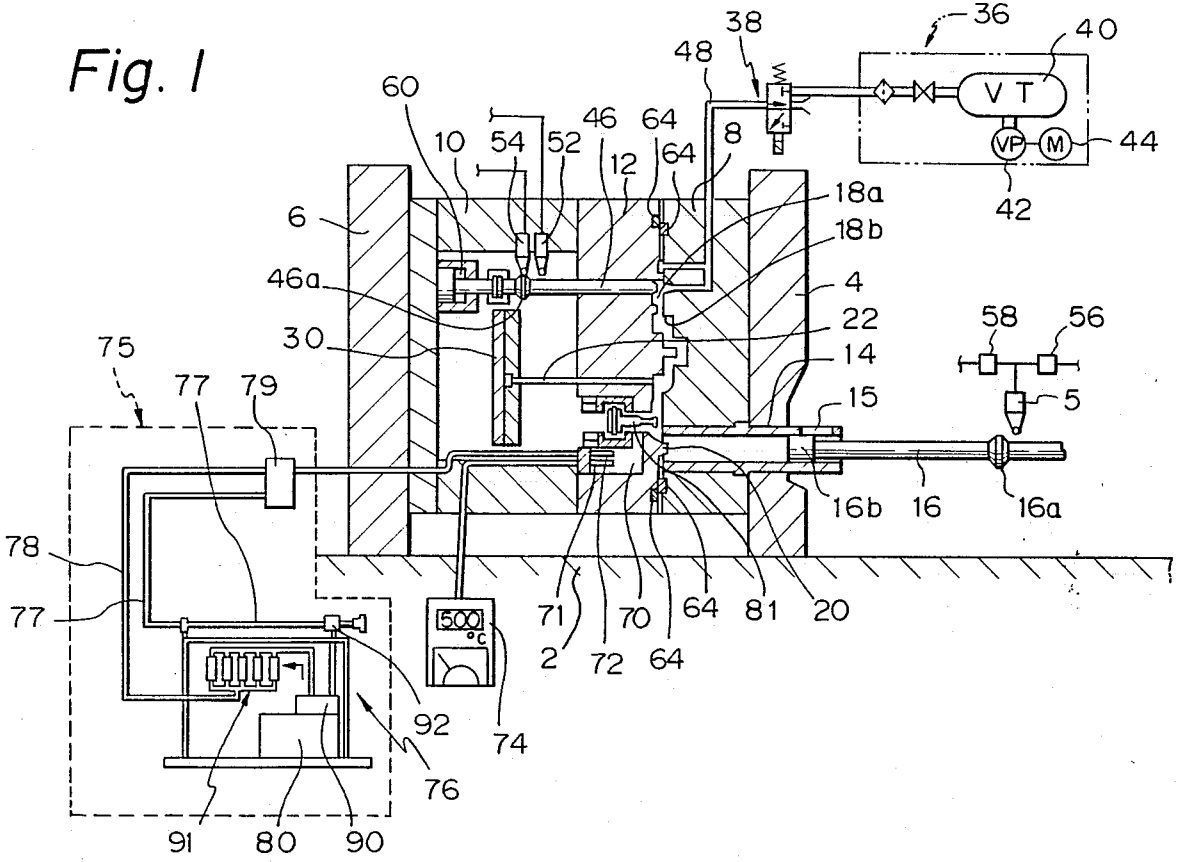
FIG. 1 is a cross-sectional view of a device as an embodiment of the present invention, in a state wherein a lubricant vapor is blown into a mold cavity.

The present invention will now be described with reference to a first embodiment shown in the drawings.

Figure 2:
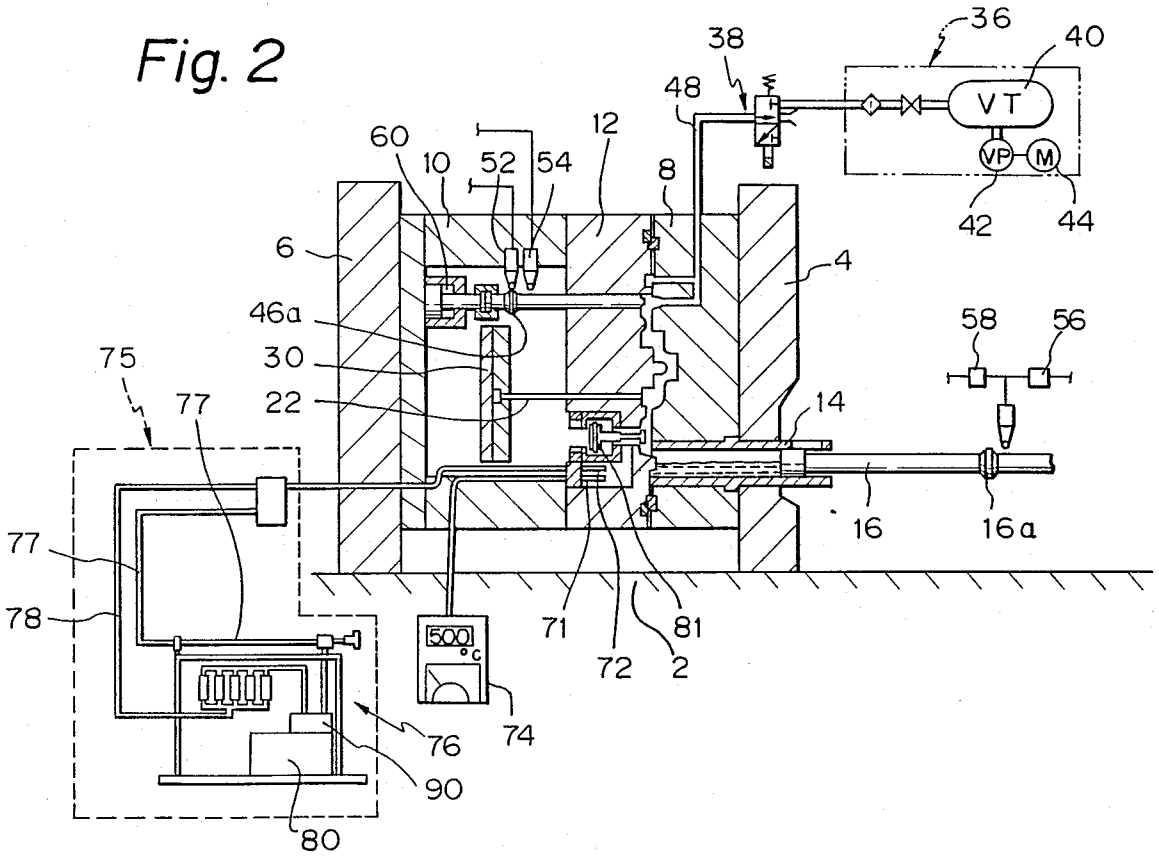
FIG. 2 is a cross-sectional view of a device as an embodiment of the present invention, in a state wherein a negative pressure is introduced into the mold cavity.

As shown in FIGS. 1 and 2, a stationary base 2 is attached to a floor of a factory, a stationary platen 4 is fixedly mounted on the stationary base 2, and a movable platen 6 is located at a position opposite the stationary platen 4. The movable platen 6 and the stationary platen 4 are interconnected by a tie-bar (not shown) in such a manner that the movable platen 6 is movable toward and away from the stationary platen 4.

A stationary mold 8 on which a mold cavity surface 18*b* is engraved is fixedly secured to the stationary platen 4. The stationary platen 4 and the stationary mold 8 are provided with an injection sleeve 14 extending therethrough. The injection sleeve 14 is a cylindrical tube having an injection plunger 16 slidably disposed therein. The injection sleeve 14 is provided with a gate 15 through which molten metal can be poured into the injection sleeve 14, and the injection plunger 16 has a large diameter portion 16*a*. The gate 15 also acts as an inlet mouth for introducing a lubricant into the sleeve 14. The lubricant is introduced into the injection sleeve 14 to lubricate a head 16*b* of the injection plunger 16, to reduce friction between the inner wall of the injection sleeve 14 and the head 16*b* of the injection plunger 16.

A die base 10 is fixedly secured to the movable platen 6, and a movable mold 12 is fixedly secured to the die base 10. The movable mold 12 has a mold cavity surface 18*b* having an engraved portion corresponding to that of the mold cavity surface 18*a* of the stationary mold 8. A mold cavity is defined by the mold cavity surfaces 18*a* and 18*b* when the movable mold 12 and stationary mold 8 are brought together, and the injection sleeve 14 communicates with the mold cavity.

A negative pressure passageway 48 is formed in the stationary mold 8 and communicated with the mold cavity defined by the mold cavity surfaces 18*a* and 18*b*. The negative pressure passageway 48 communicates with a negative pressure source 36 via a valve 38. The negative pressure source 36 comprises a vacuum tank 40, a vacuum pump 42, and a motor 44 for driving the vacuum pump 42. The valve 38 is preferably an electromagnetic valve and is used for communicating the negative pressure passageway 48 with the negative pressure source 36, or opening it to the atmosphere.

A cut-off pin 46 is disposed on the movable mold 12. The cut-off pin 46 is mounted on the movable mold 12 and extends therethrough, one end thereof being connected to a drive mechanism 60 for driving the cut-off pin 46 and the other end thereof facing the negative pressure passageway 48. When the movable mold 12 is in contact with the stationary mold 8, the intercommunication between the negative pressure passageway 48 and the mold cavity can be shut off by moving the cut-off pin 46 forward. The cut-off pin 46 has a large diameter portion 46*a*, and the position of the cut-off pin 46 is detected when the portion 46*a* comes into contact with an advance-position limit switch 52 or a retracted-position limit switch 54, which are mounted separately on the die base 10. Preferably, a hydraulic mechanism is used as the drive mechanism 60 for the cut-off pin 46.

The movable mold 12 is also provided with a plurality of ejector pins 22 for ejecting a solidified article from the mold cavity. One end of each of the ejector pins 22 communicates with an ejector plate 30, and the other end faces the mold cavity.

Figure 3:
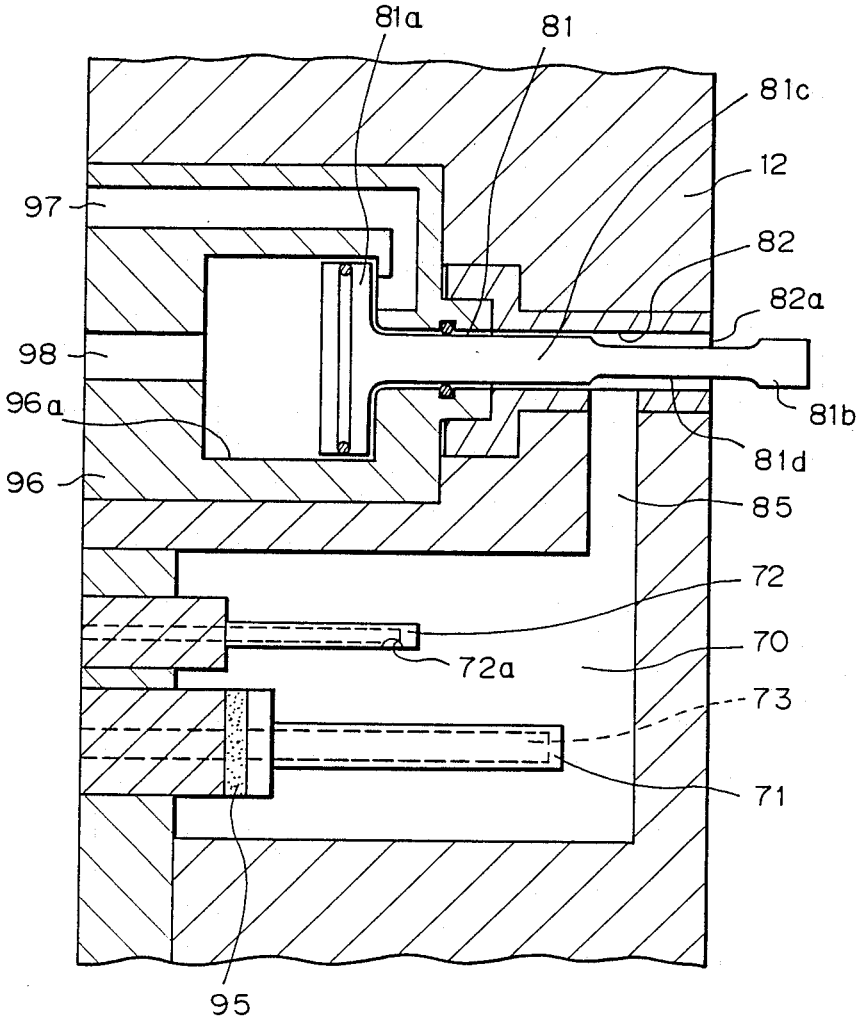
FIG. 3 is a cross-sectional view of a portion near a vapor chamber.

The movable mold 14 has a vapor chamber 70 formed therein and facing the injection sleeve 14, as shown in FIG. 3. The vapor chamber 70 is provided with a heating body 71 and a lubrication pipe 72, which compose the heating device for heating a lubricant supplied to the mold cavity surfaces 18*a* and 18*b*.

The heating body 71 is provided with a heater 73 which is connected to a temperature adjuster 74 and constantly maintained thereby at a temperature of more than 500° C. A heat insulating material 95 is provided to prevent conduction of the high temperature of the heating body 71 to the molds 8 and 12, and to ensure the function of an O ring (not shown), and the like.

The lubrication pipe 72 is disposed above the heating body 71 in the vapor chamber 70, and is provided with a spray orifice 72*a* facing the heating body 71, to spray lubricant on the heating body 71. The lubrication pipe 72 is connected to a lubrication device 75 (shown in FIGS. 1 and 2), which comprises a lubrication pump unit 76 supplying compressed air to a lubricant reservoir 80 from an air pump 90 at a predetermined timing, so that a piston (not shown) operates to supply a predetermined volume of lubricant to a control valve 91. The lubricant reservoir 80 holds a lubricant having a large molecularity and composed of synthetic oil (silicon oil), vegetable wax, a surface active agent, water, and the like.

The control valve 91 adjusts the amount of lubricant supplied from the lubricant reservoir 80 to a predetermined value, and the adjusted lubricant is introduced into a lubricant mixing block 79 through a lubricant pipe 78. A switching valve 92 is provided for selectively connecting the mixing block 79 to the atmosphere or the air pump 90. After the adjusted lubricant is introduced to the lubricant mixing block 79, the switching valve 92 is switched to supply compressed air into the lubricant mixing block 79 through an air pipe 77.

Therefore, in the mixing block 79, the lubricant introduced through the lubricant pipe 78 and the compressed air introduced through the air pipe 77 are mixed together, the movable mold 12 is moved to form the mold cavity together with the stationary mold 8, and then the lubricant mixed with the compressed air is sprayed onto the heating body 71 from the lubricant pipe 72.

In FIG. 3, a horizontally extending outlet port 82 is formed above the vapor chamber 70 in the movable mold 12 and facing the stationary mold 8, and communicates with the vapor chamber 70 through a vertical vapor passage 85. A hydraulic piston 81 is disposed above the vapor chamber 70 and in the outlet port 82, to open and close the outlet port 82.

The piston 82 has a body 81*a*, a cylindrical portion 81*c* connected to the body 81*a*, and a valve 81*b* formed on the tip portion of the cylindrical portion 81*c* and located at the opposite end thereof to the body 81*a*. An annular groove 81d is formed on an outer surface of the cylindrical portion 81c and close to the valve 81b. The body 81a is slidably housed in a bore 96a formed in a hydraulic cylinder 96 provided in the movable mold 12, and is moved forward and backward by a hydraulic circuit formed in the movable mold 12. The hydraulic circuit has first and second hydraulic passages 97 and 98 which communicate with the bore 96a to supply a high or low pressure onto the body 81a. The cylindrical portion 81c extends in the outlet port 82, and the valve 81b can project from the outlet port 82 to open the outlet port 82.

When a highly pressurized fluid is fed through the hydraulic passage 97 to the body 81a, the piston 81 moves backward so that the valve is retracted in the outlet port 82 to close the outlet port 82. Conversely, when a highly pressurized fluid is fed through the hydraulic passage 98 to the body 81a, the piston 81 moves forward so that the valve projects from the end portion 82a of the outlet port 82 to open the outlet port 82. That is, in this state, the vapor chamber 70 is communicated with outside portion of the movable mold 12 through the annular groove 81d as shown in FIG. 3.

Figure 4:
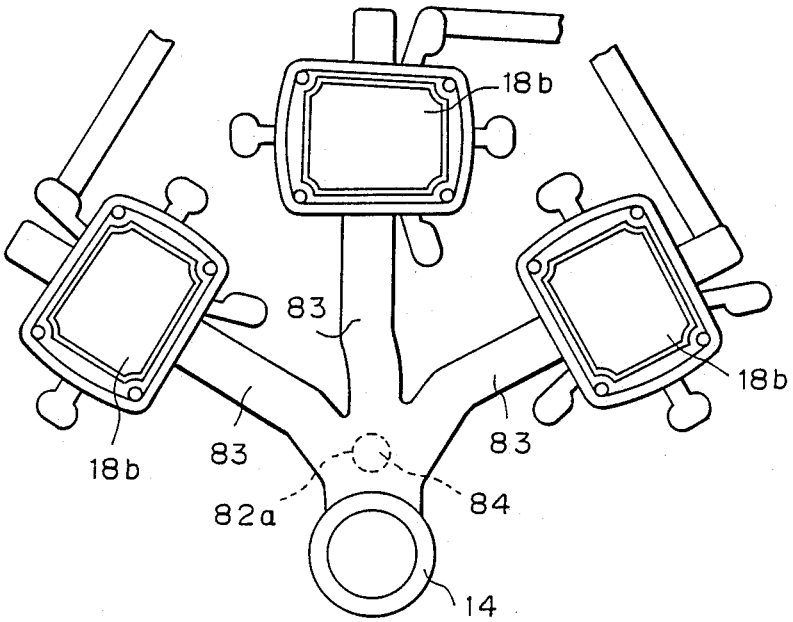
FIG. 4 is a front view of a stationary mold.

The end portion 82a of the outlet port 82 opens, as shown in FIG. 4, at the central portion 84 of runners 83 which connect the injection sleeve 14 to the mold cavities defined by the mold cavity surfaces 18a and 18b.

The sprue core 20 is formed on the movable mold 12 at a position confronting the injection sleeve 14. Usually, the movable and stationary molds 12 and 8 are provided with cooling passageways (not shown) through which cooling water is circulated.

The injection plunger 16 is formed with a large diameter portion 16a, which comes into contact with a limit switch 5 so that the position of the injection plunger 16 can be detected. The limit switch 5 is electrically connected to an intermediate-stop-position timer 56 and a pump-up timer 58.

The intermediate-stop-position timer 56 measures the time that the injection plunger 16 is stopped at the intermediate position. The pump-up timer 58 measures a period from the time that the injection plunger 16 is stopped at the intermediate position to the time that the valve 38 is switched to cause the cavity to be evacuated and thus form a negative pressure therein. The cut-off pin 46 closes the negative pressure passage 48 and the mold cavity.

A sealing member 64 is provided as a seal between the stationary and movable molds 8 and 12 when the molds are in contact with each other.

Figure 5:
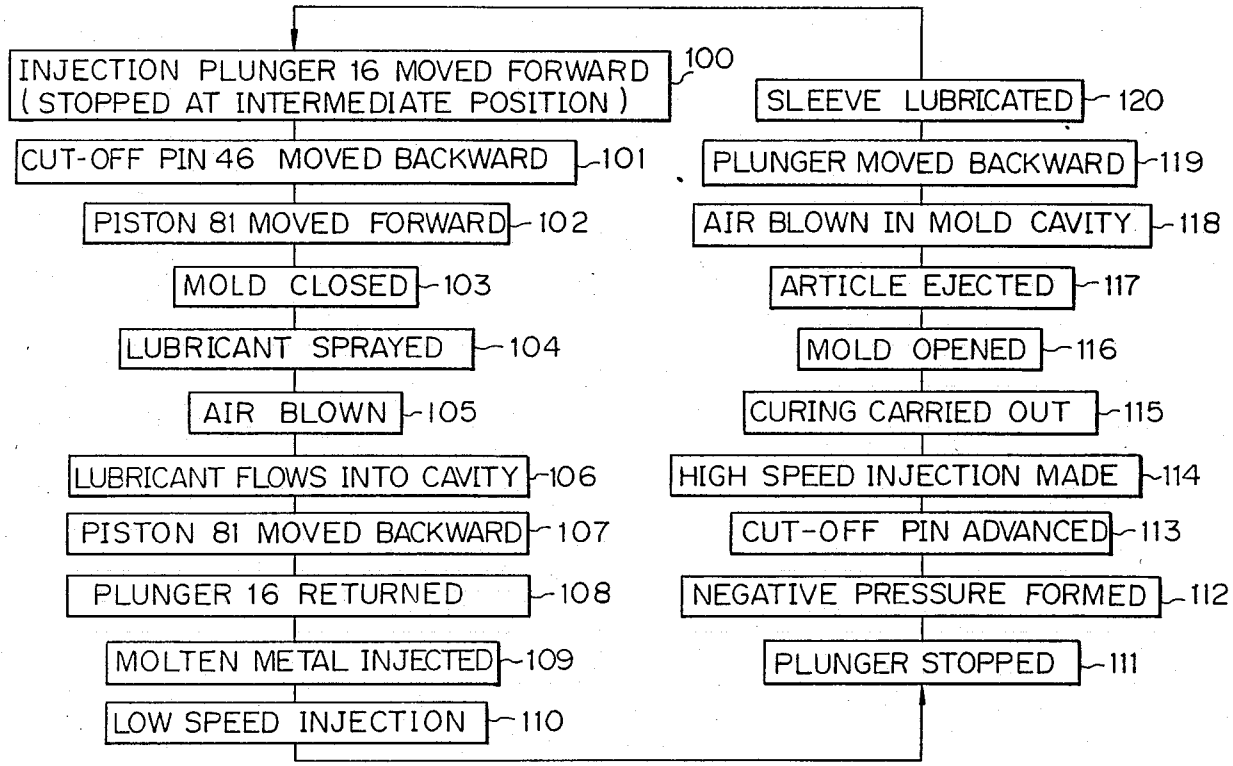
FIG. 5 is a block diagram showing a method of an embodiment of the present invention.

An operation of the embodiment is described below with reference to FIG. 5.

First, the movable mold 12 is separated from the stationary mold 8. In this state, the injection plunger 16 is moved forward, and stopped at the position (i.e., intermediate position) at which the gate 15 of the sleeve 14 is closed (step 100).

The cut-off pin 46 is then moved backward by the cut-off pin drive mechanism 60 (step 101). When the cut-off pin 46 is moved forward and backward by the cut-off pin drive mechanism 60, the forward position of the pin 46 is detected by the forward limit switch 52 and the backward position of the pin 46 is detected by the backward limit switch 54.

The hydraulic piston 81 is moved forward by the hydraulic circuit and is stopped at the position at which the outlet port 82 is open (i.e., state shown in FIG. 1) (step 102). In this state, the movable mold 12 is moved toward the stationary mold 8 to form mold cavities therebetween (step 103).

The lubrication device 75 is then operated to spray a lubricant mixed with compressed air through the lubrication pipe 72 onto the heating body 71 heated to a temperature of more than 500° C. (step 104). The lubricant is decomposed by the heat from the heating body 71, and thus most of the oil component in the lubricant is evaporated and suspended in the vapor chamber 70; the remaining oil component in the lubricant is carbonized and adheres to the heating body 71.

If the lubricant is applied on the mold cavity surfaces 18a and 18b without heating the lubricant, when molten metal is injected from the injection sleeve 14, part of the lubricant is mixed with the molten metal in a gaseous state or a liquid state which is easily gasified. In the above step 104, these components are decomposed, and the lubricant suspended in the vapor chamber 70 becomes a lubricant vapor holding the effective components necessary as a lubricant. If the lubricant has a large molecularity, including a synthesized oil (such as silicon oil), the lubricant is more effectively decomposed and a more preferable result is obtained. The oil component carbonized and adhered to the heating body 71 is removed periodically.

The lubricant vapor in the vapor chamber 70 is moved upward due to air pressure formed by spraying the lubricant mixed with compressed air onto the heating body 71 through the lubrication pipe 72, and passes through the vapor passage 85 and the outlet port 82 to be discharged to the runner center 84 (step 105) and then flow into the mold cavities. At this time, since the temperature of the mold cavity surfaces 18a and 18b forming the mold cavities is at most about 200° C., the lubricant heated to about 500° C. by the heating body 71 and flowing into the mold cavities is effectively applied on the mold cavity surfaces 18a and 18b and provides a lubricant film on the mold cavity surfaces 18a and 18b (step 106).

Then the hydraulic piston 81 is moved backward by the hydraulic circuit to cause the valve 81b to close the outlet port 82 (step 107). In this state, molten metal is prevented from flowing into the vapor chamber 70 through the runners 83.

The injection plunger 16 is then moved backward (step 108), and molten metal is poured into the injection plunger 14 through the gate 15 of the injection sleeve 14 (step 109). After the molten metal has been poured into the sleeve 14, first the injection plunger 16 is advanced to the left in the drawing at a low speed (step 110). When the molten metal occupies more than 50% of the volume of the injection sleeve 14, the advance of the injection plunger 16 is stopped (step 111). This stop of the plunger 16 is controlled by the limit switch 5. Namely, the limit switch 5 is disposed at the position at which the molten metal will occupy more than 50% of the volume of the sleeve 14, and thus the plunger is stopped at the intermediate position.

The period for which the injection plunger 16 is stopped at the intermediate position is detected by the intermediate-stop-position timer 56. The valve 38 is switched by the limit switch 5. Namely, the negative pressure passage 48 is communicated with the negative pressure source 36, and a negative pressure is formed in the mold cavities by the negative source 36 (step 112). The time elapsed since negative pressure is formed in the mold cavities is detected by the pump-up timer 58. When the timer 58 senses that a predetermined period has elapsed, the cut-off pin 46 is advanced by the cut-off pin drive mechanism 60 (step 113), so that the connection between the negative pressure passage 48 and the mold cavity is closed.

When the intermediate-position-position timer 56 detects the finish of the intermediate stop period of the injection plunger 16, the injection plunger 16 is moved forward at a high speed (step 114), and thus the molten metal in the injection sleeve 14 is injected into the mold cavities at a high speed.

When the injection of the molten metal into the mold cavities is finished, a predetermined period is allowed to elapse and the molten metal is solidified (step 115). After the solidification, the movable mold 12 is separated from the stationary mold 8 (step 116), and the ejection plate 30 is moved forward to push the solidified articles out of the mold cavities, i.e., the solidified articles are ejected from the mold cavities (step 117). High pressure air is then sprayed on the mold cavity surfaces 18*a* and 18*b*, to remove foreign matters such as burrs (step 118).

The injection plunger 16 is then moved backward (step 119), and the injection sleeve 14 is lubricated by a lubricant introduced through the gate 15 (step 120).

This concludes the one-time die-casting operation.

According to the die-casting method of the embodiment described above, since the lubricant is first decomposed by the heating body 71, even if the lubricant is mixed in the solidified article in a die-casting process, and the article is heated during use after die-casting, the lubricant is not easily decomposed. That is, the lubricant in the article does not cause a deformation of the article. Therefore, the article after solidification can be subjected to a solution heat treatment and aging treatment at a temperature of about 480° C.

Figure 8:
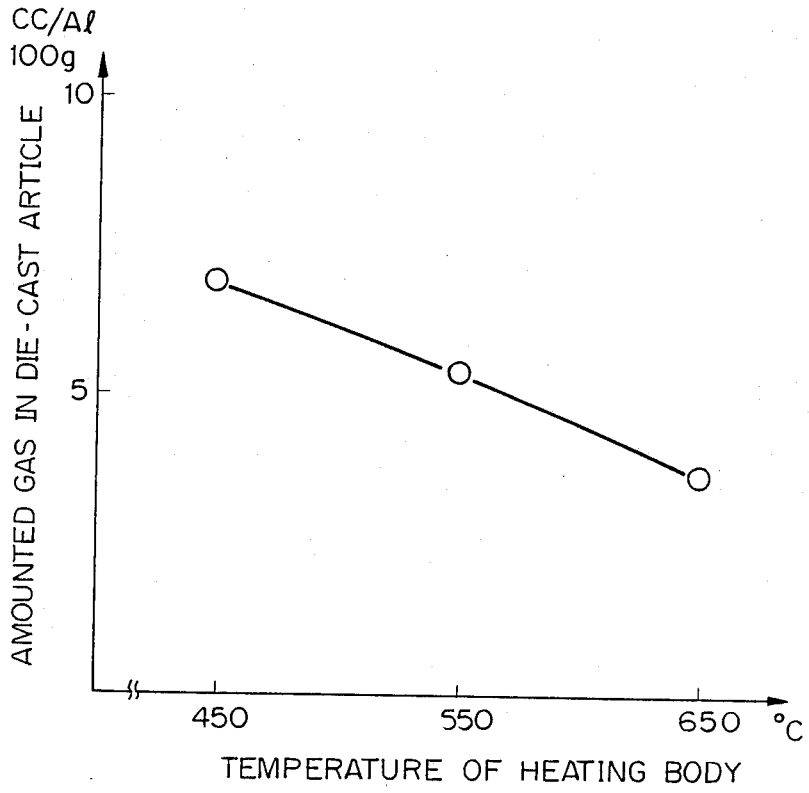
FIG. 8 is a graph showing a relationship between a temperature of a heating body and the amount of gas contained in the die-cast article.

In this embodiment, although the temperature of the heating body 71 is set to more than 500° C., the temperature is not necessarily restricted to this value. That is, any temperature is effective as long as the lubricant is heated to a temperature which will decompose the gas components in the lubricant which would otherwise expand during a heat treatment after solidification of the die-cast article. The inventors of the present invention obtained, by experiment, a relationship between a temperature (°C.) of the heating body 71 and the amount of gas (g) per 100 g in a solidified aluminum die-cast article when using 0.3 cc of lubricant vapor for a one-time die-cast. This experimental result is shown in FIG. 8. In this graph, the higher the temperature of the heating body 71, namely the greater the calories given to the lubricant, the more the lubricant is decomposed and the smaller the amount of gas mixed in the article.

In the embodiment, after the movable mold 8 and stationary mold 12 form the mold cavity, the lubricant vapor together with compressed air is flowed into the mold cavities through the outlet 82 in the movable mold 12, one end of the outlet being open to the mold cavities. Therefore, the lubricant vapor does not leak from the mold cavities, and thus the lubricant vapor is fully applied on all parts of the mold cavity surfaces 18*a* and 18*b*, including complex shape portions. Accordingly, even if a number of articles are die-cast, the molten metal does not adhere to the complex shape portions of the molds due to a lack of lubricant.

Figure 6:
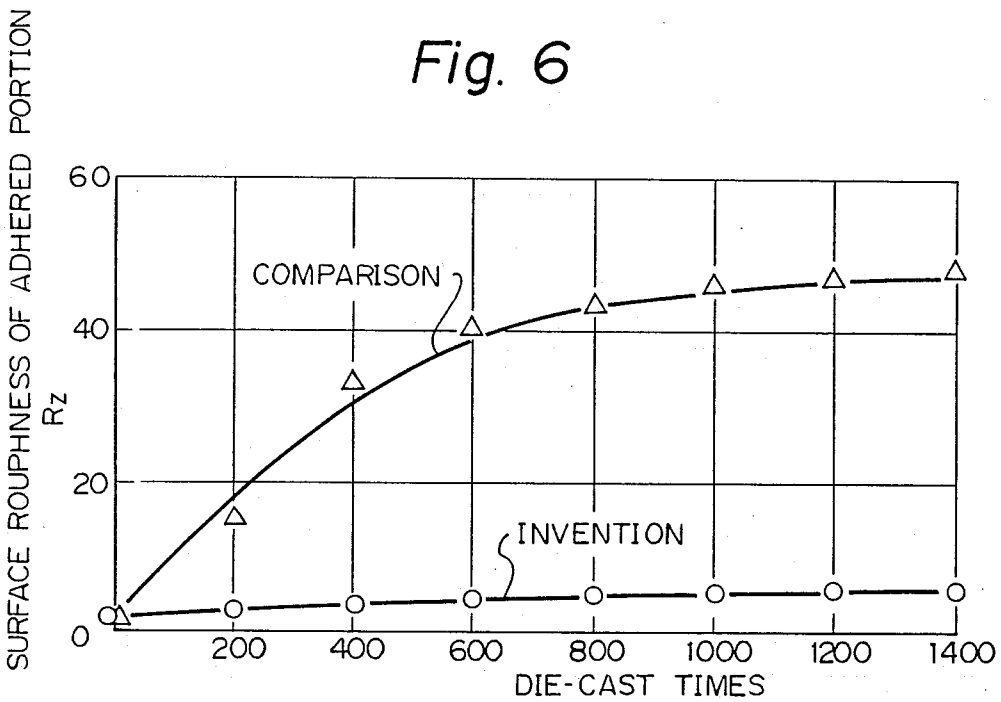
FIG. 6 is a graph showing a relationship between the number of die-casts made and a roughness of a surface of a complex shape portion.

FIG. 6 shows a relationship between the number of times die-casting was carried out and a surface roughness of a complex shape portion of the stationary mold 8, obtained by an experiment by the inventors. The comparison example shown in FIG. 6 shows a case in which a lubricant is sprayed on the sprue core 20, which part has the highest temperature in the mold, to be decomposed and introduced into the mold cavities. In the comparison example, the mold is the same as used in the invention, and the measurement of the surface roughness is carried out at the same portion of the stationary mold 8 as in the invention.

As understood from FIG. 6, in the comparison example, as the number of times that a die-cast carried out is increased, the surface roughness becomes worse, and molten metal is easily adhered to the mold. Conversely, in the embodiment of the present invention, the surface roughness is substantially unchanged and such adhesion is not worsened. This means that the lubricant vapor flows into the mold cavities through the runners 83, which are also passages through which molten metal flows, so that the lubricant is fully applied on the complex shape portions where the adhesion of the molten metal easily occurs; namely, the mold is fully lubricated.

Figure 7:
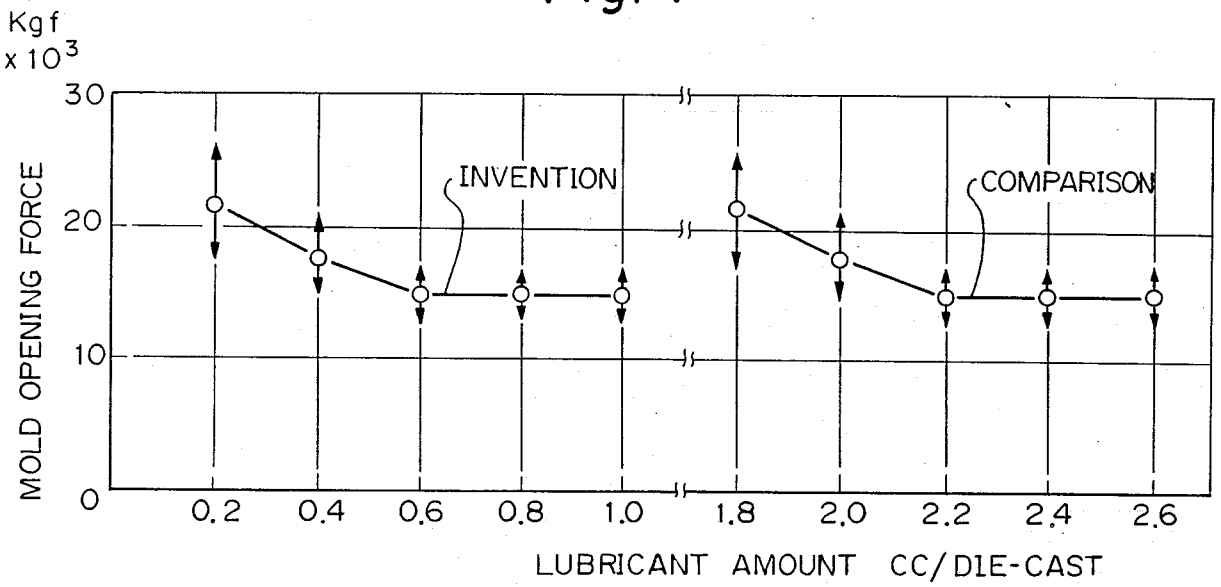
FIG. 7 is a graph showing a relationship between the amount of lubricant vapor and a force needed for removing an article from the molds.

FIG. 7 shows a relationship between the amount of lubricant and the force needed to open the molds when the solidified article is ejected from the molds, in the same molds. The die-casting method carried out in the comparison example shown in FIG. 7 is the same as that shown in FIG. 6. FIG. 7 shows a relationship between the amount of lubricant sprayed on the sprue core 20 and the force needed to release the movable mold from the stationary mold.

As shown in FIG. 7, according to the embodiment, the amount of lubricant vapor needed per one die-cast to carry out a predetermined lubrication is less than in the comparison example. This means that the lubricant vapor does not leak from the mold cavities, and is fully applied on the mold cavity surfaces 18*a* and 18*b*.

As described above, in the embodiment, a predetermined amount of lubricant vapor is sprayed into the mold cavities, and the lubricant vapor is fully applied on the mold cavity surfaces 18*a* and 18*b* without leaking from the mold cavities. Therefore, even if the applied portions are complex shape portions, since the lubricant is fully applied thereon, molten metal does not adhere to the molds, and as a result, the life of mold is prolonged and die-casting can be carried out continuously.

In the embodiment, the lubricant in the vapor chamber 70 is discharged to the central portion 84 of the runners 83 through the annular groove 81*d* formed on the outer surface of the cylindrical portion 81*c* of the piston 81, but the outer surface of the cylindrical portion 81*c* may be provided with a plurality of grooves extending along the axis of the cylindrical portion 81*c* and corresponding to each runner 83, so that the lubricant vapor in the vapor chamber 70 is discharged to each runner 83 through the annular grooves 81*d* and the axial grooves, and thus the lubricant vapor is more surely supplied to the mold cavities.

Figure 9:
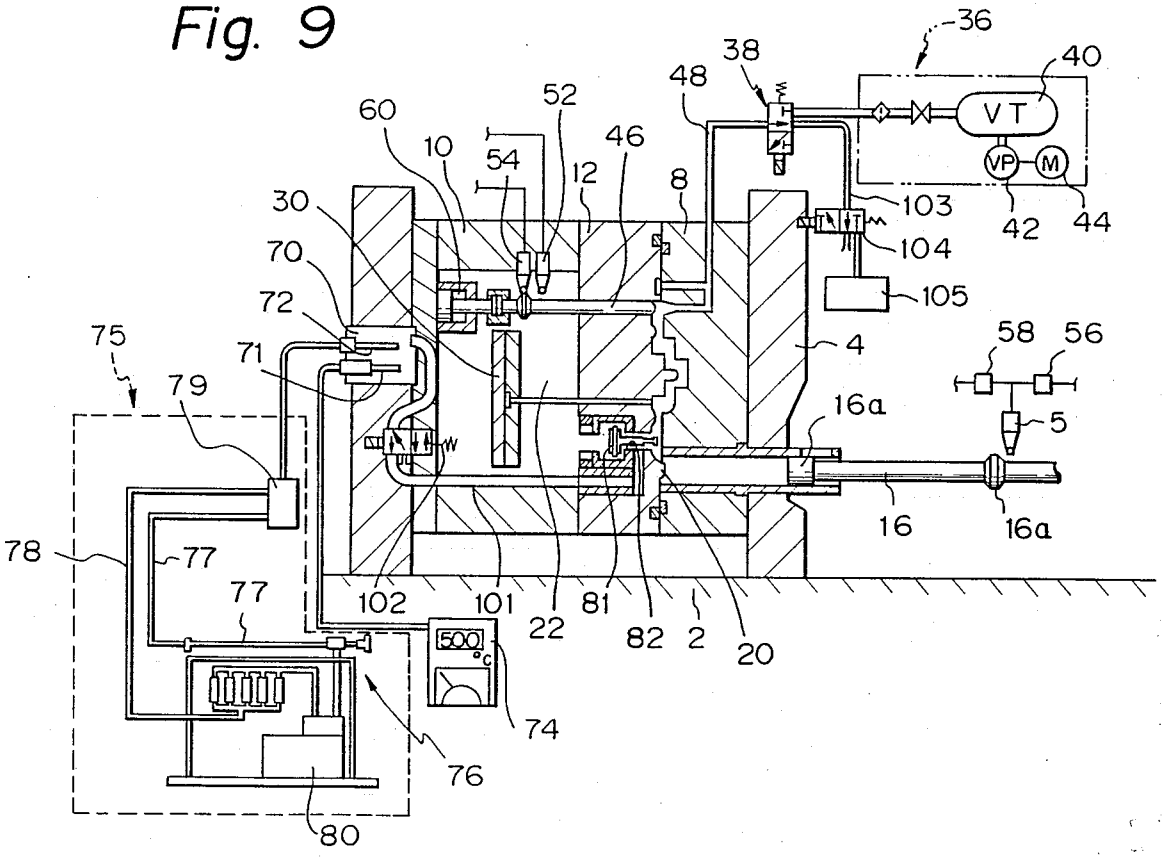
FIG. 9 is a cross-sectional view of a device as another embodiment of the present invention.

FIG. 9 shows a second embodiment of the present invention. The vapor chamber 70 is provided in the movable mold 12 in the first embodiment but is formed in the movable platen 6 in this second embodiment, and the lubricant vapor is introduced to the outlet port 82 through a pipe 101 connecting the vapor chamber 70 to the outlet port 82 in the movable mold 12. A switch valve 102 is provided in the pipe 101 to open and close the pipe 101, so that a predetermined amount of lubricant vapor is introduced to the piston 81 at a predetermined timing by operation of the valve 102. According to this construction, since the vapor chamber 70 provided with the heating body 71 and the lubrication pipe 72 is not formed in the movable mold 12, maintenance of the mold is made easier and the cost of the mold is cheaper than in the first embodiment. Further, cleaning of the vapor chamber 70 is easier than in the first embodiment.

In the second embodiment, the valve 38 provided in the negative pressure passage 48 is connected to the negative pressure source 36 and a pipe 103 provided with a valve 104, which is connected to a compressed air source 105 and the atmosphere. Before molten metal is injected into the mold cavities from the injection sleeve 14, the valve 38 is switched so that the negative pressure passage 48 is communicated with the negative pressure source 36, and thus a negative pressure is formed in the mold cavities. When lubricant vapor is introduced into the mold cavities, the valve 38 is switched so that the negative pressure passage 48 is communicated with the pipe 103, and the valve 104 is switched so that the pipe 103 is communicated with the compressed air source 105, so that the passage 48 is communicated with the compressed air source 105. Therefore, lubricant vapor in the negative pressure passage 48 is returned into the mold cavities from the negative pressure passage 48.

The remaining construction and operation are the same as in the first embodiment.

Lubricant vapor may be introduced into the mold cavities from the injection sleeve 14, or directly introduced without flowing through a member, or introduced from a portion such as the negative pressure passage 48 where molten metal overflows from the mold cavities.

As described above, according to the die-casting method of the present invention, the lubricant introduced into the mold cavities is heated by the heating device to a temperature higher than a temperature of the mold cavity surfaces immediately before molten metal is introduced into the mold cavities. Therefore, the lubricant vapor is effectively applied on the mold cavity surfaces, and when molten metal is introduced into the mold cavities, components of the lubricant which are easily mixed in the molten metal in a gaseous state or in a state in which the lubricant is easily gasified, are reduced. Therefore, even if the solidified article is subjected to a heat treatment, the article is not deformed.

Since the lubricant is introduced into the mold cavities by compressed air after the mold cavities are formed, the lubricant is applied on all portions, including complex shape portions, without leaking from the mold cavities. Therefore, even if a plurality of articles are die cast at the same time, the molten metal does not adhere to the complex shape portions of the molds.

The above method is easily carried out by the device according to the present invention.

While embodiments of the present invention have been described herein with reference to the attached drawings, many modifications and changes may be made by those skilled in this art without departing from the scope of the invention.

We claim:

1. A die-casting method using a first mold having a mold cavity surface, a second mold having a mold cavity surface and brought into contact with said first mold so that said mold cavity surfaces of said first and second molds define a mold cavity, means for injecting a molten metal into said mold cavity, means for ejecting from said mold cavity a solidified article made by allowing said molten metal to solidify, and a heating device heating a lubricant, said method comprising the steps of:

forming said mold cavity by bringing said second mold into contact with said first mold;

heating said lubricant to a temperature higher than a temperature of said mold cavity surfaces of said first and second molds before said molten metal is injected into said mold cavity, so that said lubricant is decomposed;

then introducing said decomposed lubricant into said mold cavity so that said lubricant is condensed and applied on said mold cavity surfaces of said first and second molds;

injecting said molten metal into said mold cavity;

allowing said molten metal to solidify in said mold cavity;

separating said second mold from said first mold; and ejecting the solidified article from said mold cavity.

2. A die-casting method according to claim 1, wherein said forming step and said heating step are carried out simultaneously.

3. A die-casting method according to claim 1, wherein said lubricant heated by said heating device is introduced into said mold cavity by compressed gas.

4. A die-casting method according to claim 3, wherein said compressed gas is compressed air.

5. A die-casting method according to claim 1, wherein, when said lubricant is heated, said lubricant becomes a vapor containing at least one effective component necessary as for lubrication.

6. A die-casting method according to claim 5, wherein said lubricant contains silicone oil as a main component.

7. A die-casting method according to claim 1, wherein said molten metal is an aluminum alloy.

8. A die-casting method according to claim 7, wherein, after said ejecting step, said solidified article is subjected to a solution heat treatment and then an aging treatment.

9. A die-casting method according to claim 8, wherein the temperature to which said lubricant is heated is higher than a temperature used in the solution heat treatment.

10. A die-casting method according to claim 1, further comprising, immediately before said injecting step, the step of forming a negative pressure in said mold cavity.

11. A die casting device comprising:

a first mold having a mold cavity surface;

a second mold having a mold cavity surface and brought into contact with said first mold so that said mold cavity surfaces of said first and second molds define a mold cavity;

an injection sleeve for injection molten metal into said mold cavity;

an injection plunger slidably disposed within said injection sleeve to inject said molten metal into said mold cavity;

means for heating a lubricant to a temperature higher than a temperature of said mold cavity surfaces of said first and second molds before said molten metal is injected into said mold cavity, so that said lubricant is decomposed; and means for introducing said decomposed lubricant into said mold cavity.

12. A die-casting device according to claim 11, wherein the temperature of said mold cavity surfaces of said first and second molds before said molten metal is injected into said mold cavity is at most 200° C., and said lubricant is heated to about 500° C.

13. A die-casting device according to claim 11, wherein said heating means is provided outside said second mold.

14. A die-casting device according to claim 11, wherein said lubricant heated by said heating device is introduced into said mold cavity by compressed gas.

15. A die-casting device according to claim 14, wherein said compressed gas is compressed air.

16. A die-casting device according to claim 14, wherein said first or second mold is provided with a passage communicating with said mold cavity, through which said lubricant is introduced into said mold cavity by compressed gas.

17. A die-casting device according to claim 16, wherein said passage has an outlet port open to said mold cavity, and said introducing means has a valve for opening and closing said outlet port.

18. A die-casting device according to claim 17, wherein said introducing means has a piston provided with said valve, said piston moving forward so that said valve projects from said outlet port to open said outlet port, and moving backward so that said valve is retracted in said outlet port to close said outlet port.

19. A die-casting device according to claim 11, wherein said molten metal is an aluminum alloy.

20. A die-casting device according to claim 11, further comprising means for forming a negative pressure in said mold cavity before said molten metal is injected into said mold cavity.

21. A die casting device comprising:

a first mold having a mold cavity surface;

a second mold having a mold cavity surface and brought into contact with said first mold so that said mold cavity surfaces of said first and second molds define a mold cavity;

an injection sleeve for injecting molten metal into said mold cavity;

an injection plunger slidably disposed within said injection sleeve to inject said molten metal into said mold cavity, said heating means comprising a heating body heated to a temperature higher than a temperature of said mold cavity surfaces of said first and second molds before said molten metal is injected into said mold cavity, and a lubrication pipe for spraying lubricant on said heating body;

means for heating a lubricant to a temperature higher than a temperature of said mold cavity surfaces of said first and second molds before said molten metal is injected into said mold cavity; and means for introducing said lubricant heated by said heating means into said mold cavity.

22. A die-casting device according to claim 21, wherein said lubrication pipe is disposed above said heating body.

23. A die casting device comprising:

a first mold having a mold cavity surface;

a second mold having a mold cavity surface and brought into contact with said first mold so that said mold cavity surfaces of said first and second molds define a mold cavity;

an injection sleeve for injecting molten metal into said mold cavity;

an injection plunger slidably disposed within said injection sleeve to inject said molten metal into said mold cavity;

means for heating a lubricant to a temperature higher than a temperature of said mold cavity surfaces of said first and second molds before said molten metal is injected into said mold cavity, said heating means being housed in a chamber formed in said second mold; and means for introducing said lubricant heated by said heating means into said mold cavity.

* * * * *